US006176055B1

(12) United States Patent
Fu

(10) Patent No.: US 6,176,055 B1
(45) Date of Patent: Jan. 23, 2001

(54) MODULAR FOUNDATION SYSTEM

(76) Inventor: Chen-Wei Fu, 18228 28th Ave., NE., Kenmore, WA (US) 98028

( * ) Notice: Under 35 U.S.C. 154(b), the term of this patent shall be extended for 0 days.

(21) Appl. No.: 09/251,832

(22) Filed: Feb. 17, 1999

(51) Int. Cl.[7] ..... E02D 5/80

(52) U.S. Cl. ..... 52/292; 52/297; 52/295; 52/167.7; 52/167.9; 52/742.1

(58) Field of Search ..... 52/292, 293.1, 52/169.1, 169.9, 167.7, 167.8, 167.9, 294, 295, 296, 297, 742.1

(56) References Cited

U.S. PATENT DOCUMENTS

| | | | | |
|---|---|---|---|---|
| 844,297 | * | 2/1907 | Boland | 52/295 |
| 1,647,925 | * | 11/1927 | May | 52/294 |
| 1,837,145 | * | 12/1931 | Brooks | 52/169.1 |
| 4,232,846 | * | 11/1980 | Bressani | 52/295 X |
| 5,172,528 | * | 12/1992 | Clarke | 52/198 |
| 5,205,097 | * | 4/1993 | Harvey | 52/294 |
| 5,746,036 | * | 5/1998 | Angelette | 52/295 |

FOREIGN PATENT DOCUMENTS

| | | | | |
|---|---|---|---|---|
| 404055522 | * | 4/1991 | (JP) | 52/294 |
| 87420 | * | 4/1991 | (JP) | 52/295 |

OTHER PUBLICATIONS

Civil Engineering, vol. 68, No. 5, May, 1998; pp. 77–78.*
Practical Pole Building Construction; Sedon, Leigh W.; 1985; pp. 66–67.*
Low–Cost Pole Building Construction; Merrilees, Loveday and Wolfe; 1980; pp. 14 and 20.*
Pole Building Projects; Burch, Monte; 1993; p. 26.*

* cited by examiner

*Primary Examiner*—Carl D. Friedman
*Assistant Examiner*—Phi Dieu Tran A
(74) *Attorney, Agent, or Firm*—Gregory W. Moravan

(57) ABSTRACT

A modular foundation system having a punch pad; preformed, ring-shaped modular foundation units; and an axial column and a pole that extend through the modular foundation units. The modular foundation system may be used to support any type of structure, such as a pole building type structure; or may be used to provide pier footings for any non-pole building type structure, such as a terrace and wall type structure. The modular foundation system may have a modular foundation unit locking means for aligning and locking together adjacent modular foundation units; an axial column locking means for locking together the axial column and the modular foundation units; a modular foundation unit ground locking means for locking together the modular foundation units and the surrounding ground; an axial column connecting means for connecting together the punch pad and the axial column; a punch pad locking means for aligning and locking together the punch pad and the adjacent modular foundation unit; and punch pad ground locking means for locking together the punch pad and the surrounding ground. The punch pad and/or the modular foundation units may comprise a ring-shaped core and a used tire that may serve as a form for the ring-shaped core. The modular foundation units and the punch pad may be provided in various sizes; and one of the modular foundation units may be used as the punch pad.

18 Claims, 5 Drawing Sheets

MODULAR FOUNDATION SYSTEM

CROSS-REFERENCE TO RELATED APPLICATIONS

Not Applicable. That is, the benefit of the filing date of a co-pending application for a patent that was previously filed in the United States is not sought under 35 U.S.C. §120.

STATEMENT REGARDING FEDERALLY SPONSORED RESEARCH AND DEVELOPMENT

Not Applicable. That is, the U.S. Government does not have a paid-up license in this invention or the right in limited circumstances to require the patent owner to license others on reasonable terms.

BACKGROUND OF THE INVENTION

The present invention relates to foundation systems for structures. More particularly, the present invention relates to a modular foundation system that may be assembled at the job site.

SUMMARY OF THE INVENTION

A conventional pole building foundation system comprises vertical load bearing wooden poles having their lower ends buried in the earth. The wooden poles must be treated with preservatives to repel insects and decay. In order to increase their load bearing capacity, the lower ends of the wooden poles may be supported by a punch pad and/or may be provided with a concrete encasement. The concrete encasement may be a butt encasement, in which only part of the lower end of the wooden pole that is located below the ground finish line is encased; or it may be a full encasement, in which all of the lower end of the wooden pole that is located below the ground finish line is encased. Whether a butt encasement or a full encasement is used, the encasement will also increase the wooden pole's uplift strength, and wind deflection resistance.

Such conventional pole building foundation systems are economical and strong. However, they may be undesirable since they may be correctly perceived to have a relatively short lifetime, since even treated wooden poles will eventually be subject to failure due to insect damage and decay. In addition, the preservatives used to treat the wooden poles may present environment concerns since the preservatives are poisons that are toxic to many life forms. Further, if butt or full concrete encasements are desired, it may be difficult, or even impossible, for a conventional pre-mixed concrete delivery truck to reach the job site to pour the encasements; and it may be difficult and expensive to mix the large quantities of concrete needed for the encasements at the job site.

Turning now to the modular foundation system of the present invention, it may comprise at least two ring-shaped, pre-formed, stackable, modular foundation units, each defining an axial opening. The modular foundation units may be made from any suitable material, such as concrete. The modular foundation system may further comprise a pole and an axial column that may extend through the axial openings of the modular foundation units. The pole may comprise several reinforced metal bars, or a metal pipe; and may have a length selected to enable it to extend upwardly to and/or into the structure it is intended to support.

In order to use the modular foundation system, a foundation hole must first be formed at the job site for each modular foundation system. The modular foundation units may then be stacked in the foundation hole; the pole may be located in the axial holes of the modular foundation units; and the axial column may then be poured, with the modular foundation units serving as permanent forms for the axial column. The axial column may be made from any suitable material, such as concrete. Once it has hardened, the axial column may serve to hold the modular foundation units and the pole together as one strong, integral structure; and the pole may serve to not only support the structure, but to also reinforce the axial column and the modular foundation units.

At least one of the modular foundation units may have an outer radial size that is greater than the outer radial size of at least one of the other modular foundation units, in order to help increase the load bearing capacity, uplift strength and wind resistance of the completed modular foundation system.

The modular foundation system may further comprise modular foundation unit locking means for helping to properly align the adjacent modular foundation units with respect to each other; and/or for helping to prevent the adjacent modular foundation units from moving laterally with respect to each other. Such modular foundation unit locking means may comprise complimentary shapes or configurations in the adjacent upper and lower surfaces of the adjacent modular foundation units.

The modular foundation system may also comprise axial column locking means for helping to lock the modular foundation units and the axial column together, and for helping to prevent relative axial motion between the modular foundation units and the axial column; after the axial column has been poured and has hardened. Such axial column locking means may comprise one or more grooves, flanges, lugs and/or recesses on the inner radial surfaces of at least one of the modular foundation units.

The modular foundation system may further comprise modular foundation unit ground locking means for helping to lock the modular foundation units and the surrounding ground together; thereby desirably providing greater friction between the modular foundation units and the ground. The greater friction provided by the modular foundation unit ground locking means may increase the load bearing capacity, uplift strength and wind resistance of the modular foundation system. The modular foundation unit ground locking means may comprise one or more grooves, flanges, lugs and/or recesses on the outer radial surface of at least one of the modular foundation units.

The modular foundation system may also comprise a punch pad upon which the modular foundation units may be stacked in the foundation hole. The punch pad may be pre-formed and lowered into the foundation hole; or it may be poured in the foundation hole and allowed to set before the modular foundation units are stacked upon it. The punch pad may be made from any suitable material, such as concrete. The punch pad may comprise a dowel to integrally connect it to the axial column when the axial column is poured. If a punch pad is used, then it may also serve as the permanent form for the bottom of the axial column. If a punch pad is not used, then the bottom of the foundation hole may serve as the form for the bottom of the axial column.

The modular foundation system may further comprise a punch pad locking means for helping to properly align the punch pad and its adjacent modular foundation unit with respect to each other; and/or for helping to prevent the punch pad and its adjacent modular foundation unit from moving laterally with respect to each other. Such punch pad locking means may comprise complimentary shapes or configurations in the upper surface of the punch pad and the lower surface of its adjacent modular foundation unit. Such complimentary shapes or configurations may comprise, for example, complimentary grooves, flanges, lugs and/or recesses in the upper surface of the punch pad and the lower surface of its adjacent modular foundation unit.

As an alternative, the punch pad may be eliminated and may be replaced by one of the modular foundation units that has an outer radial size that is larger than the outer radial size of at least one of the other modular foundation units in the modular foundation system.

The modular foundation system may further comprise punch pad ground locking means for helping to lock the punch pad and the surrounding ground together; thereby desirably providing greater friction between the punch pad and the ground. The greater friction provided by the punch pad ground locking means may increase the load bearing capacity, uplift strength and wind resistance of the modular foundation system. The punch pad ground locking means may comprise one or more grooves, flanges, lugs and/or recesses on the outer radial surface of the punch pad.

The modular foundation units, the axial column and/or the punch pad may further comprise reinforcing means, such as rebar (reinforcing bar), reinforcing mesh and/or reinforcing fibers.

The modular foundation units and/or the punch pad may be preformed by pouring concrete, or any other suitable material, into used tires; with the used tires forming permanent parts of the modular foundation units and/or punch pad. Such use of used tires may offer many advantages. For example, their use may eliminate the cost of disposable forms; and may eliminate the cost and labor of using re-useable forms. In addition, since the used tires may form permanent parts of the modular foundation units and/or punch pad, the used tires are automatically, safely and permanently disposed of, in an environmentally friendly fashion, when the modular foundation units and/or punch pad are buried in the foundation hole.

If a modular foundation unit and or a punch pad comprises a used tire, then the modular foundation ground locking means and/or the punch pad ground locking means may comprise any remaining tread on the used tire, and/or any suitable projecting members, such as rods, wires, nails or screws, that were driven through the tread of the tire from inside of the tire, before the tire was used as a mold for the modular foundation unit and/or the punch pad.

The modular foundation system of the present invention may be used to support any type of structure in any suitable way. For example, it may be used to provide a foundation for a pole building type structure; or to provide pier footings for any kind of non-pole building type structure, such as a terrace and wall type structure. In addition, the modular foundation system of the present invention may be used to support any other kinds of objects or structures, such as, for example, towers, masts, commercial light poles, flag poles, antenna poles, electric power poles, roads and bridges; and may be used as reinforcing members, such to shore up or reinforce mines or roadway embankments. The modular foundation system of the present invention may be used when partially or entirely under water, such as when it is used in a foundation for a bridge or for any building on wetlands.

The modular foundation system of the present invention offers numerous advantages. For example, its individual components may be quickly and easily manufactured and transported to virtually any job site, no matter how remote or inaccessible; and then quickly and easily assembled in its foundation hole at the job site. This is because although the total weight and size of the modular foundation system may be very substantial; the much smaller weight and size of each of its individual components may enable them to be manufactured, transported, handled and installed relatively easily.

The modular foundation system of the present invention may offer the further advantage of drastically minimizing the amount of fluid concrete (or other suitable material) that must be transported to the job site. This is because the modular foundation units and/or the punch pad may be pre-formed at any convenient location before being transported to the job site. Thus, the only fluid concrete needing to be delivered to, or mixed at, the job site would be that needed for the modular foundation system's axial column; and for its punch pad, if the punch pad is poured in place at the bottom of the foundation hole. Thus, the volume of fluid concrete needed at the job site for the modular foundation system may comprise only a small fraction of the total volume of concrete used the entire modular foundation system.

Another advantage of the modular foundation system of the present invention may be that the stackable nature of its modular foundation units and/or punch pad may permit the vertical height of the modular foundation system to varied at will, by simply varying the number and/or the axial thickness of the modular foundation units that are used; and/or by varying the axial thickness of the punch pad.

A further advantage of the modular foundation system of the present invention may be that it may be easily adapted to accommodate any desired load bearing capacity, uplift strength, and wind deflection resistance. This may be done by suitably varying the outer radial size of the modular foundation units and/or the punch pad.

It should be understood that the foregoing summary of the present invention does not set forth all of its features, advantages, characteristics, structures, methods and/or processes; since these and further features, advantages, characteristics, structures, methods and/or processes of the present invention will be directly or inherently disclosed to those skilled in the art to which it pertains by all of the disclosures herein.

DESCRIPTION OF THE PREFERRED EMBODIMENTS

Referring now to the Figures, the modular foundation systems 10 of the present invention, each being located in a respective foundation hole 36 in the ground 34, may be used to support any type of structure in any suitable way.

Figure 1:
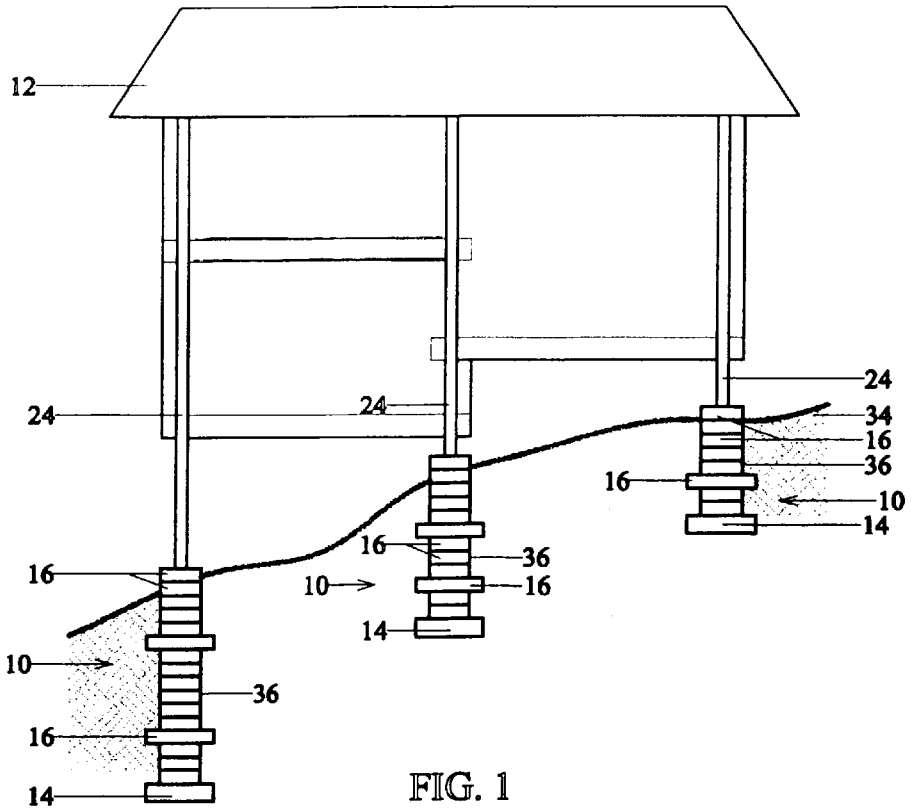
FIG. 1 is a side elevational view of the modular foundation systems 10 of the present invention being used to support a pole building type structure 12, with the structure 12 being shown partially in cross-section, and with the ground 34 being broken away for clarity.
Figure 2:
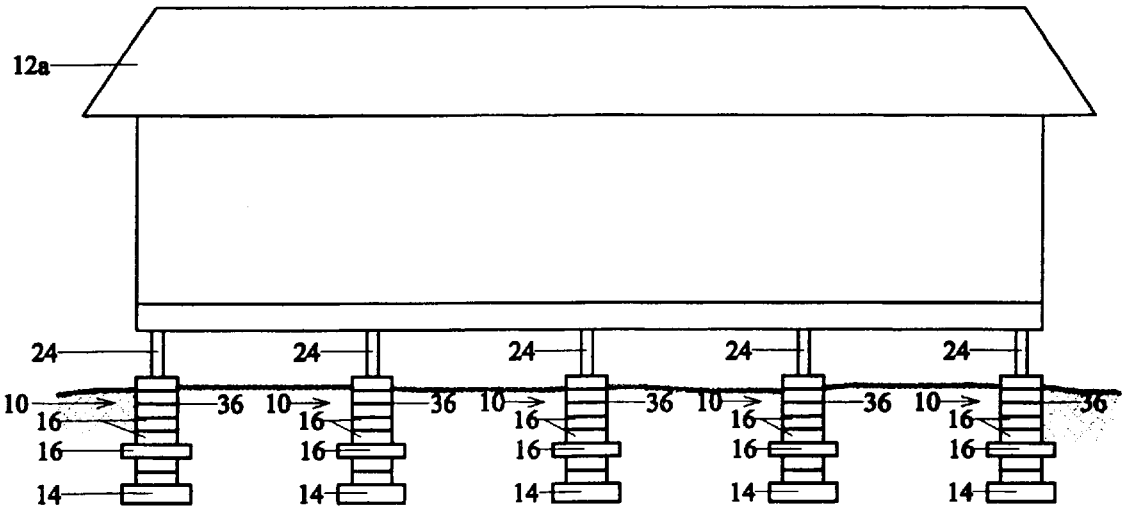
FIG. 2 is a front elevational view of the modular foundation systems 10 of the present invention being used to provide pier footings for a terrace and wall type structure 12*a,* with the ground 34 being broken away for clarity.

For example, the modular foundation systems 10 may be used to support the pole building type structure 12 of FIG. 1; or to provide pier footings for any type of non-pole building type structure, such as the terrace and wall type structure 12*a* of FIG. 2. In addition, the modular foundation systems 10 may be used to support any other type of structure, such as a tower or a mast.

Although several modular foundation systems 10 are illustrated as supporting the structures 12, 12*a* illustrated in FIGS. 1 and 2, as few as one modular foundation system 10 may be used, such as where the structure 12 comprises a tower or a mast.

In the description herein, only one modular foundation system 10 will be described in detail, it being understood that part or all of that description may apply equally well to one or more of the other modular foundation systems 10, as appropriate.

Similarly, in the description herein regarding the punch pad 14, it will be understood that part or all of that description may apply equally well to the alternative punch pad 14*a,* as appropriate; and vice versa. Likewise, in the description herein regarding the modular foundation unit 16, it will be understood that part or all of that description may apply equally well to the alternative modular foundation units 16*a,* 16*b,* as appropriate; and vice versa.

Figure 3:
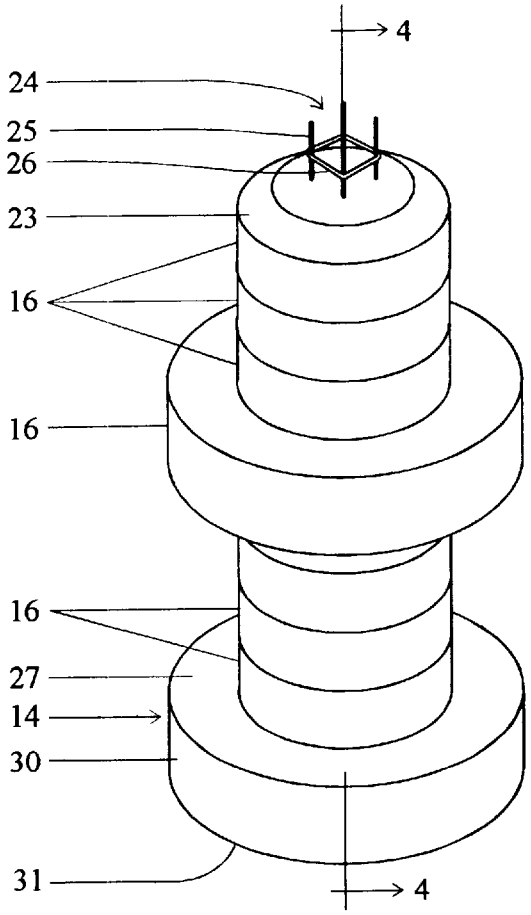
FIG. 3 is a perspective view of a completed modular foundation system 10 of the present invention, with the ground 34 being broken away for clarity.
Figure 4:
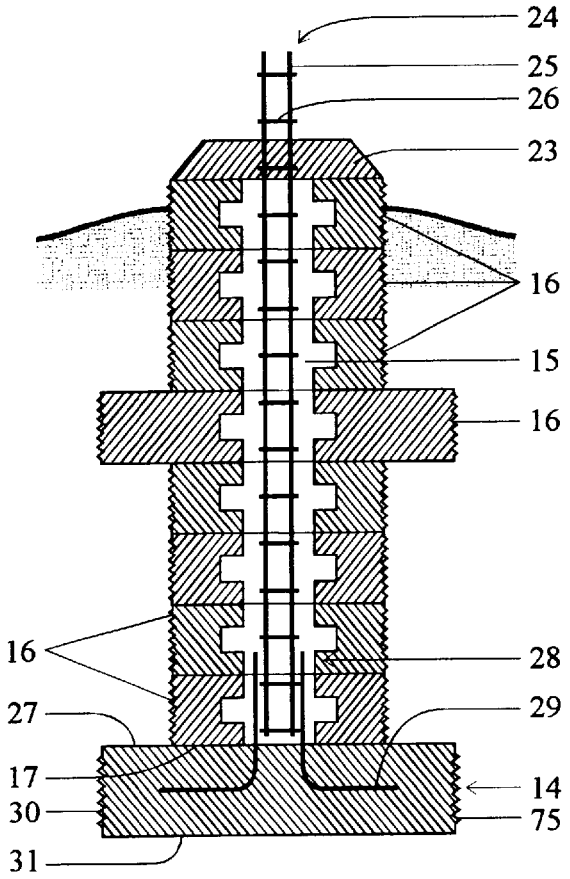
FIG. 4 is a cross-sectional view, taken along line 4—4 of FIG. 3.

As seen in FIGS. 3–4, the modular foundation system 10 may comprise a punch pad 14; an axial column 15 having a cap 23; and at least one modular foundation unit 16. For any particular structure 12 having at least two modular foundation systems 10, the number of the modular foundation units 16 in each of its modular foundation systems 10 may or may not be the same.

Although the longitudinal axes of the punch pad 14, the axial column 15, and the modular foundation units 16 are illustrated as being coaxial with respect to each other; the longitudinal axes of the punch pad 14, the axial column 15, and/or the modular foundation units 16 may not be coaxial with respect to each other.

The punch pad 14, the axial column 15, the axial column 15's cap 23, and each modular foundation unit 16 may comprise any suitable moldable, formable or castable construction material such as cement; concrete; grout; mortar; recycled rubber from tires; recycled steel, such as from cars and machinery; recycled resins or plastics, such as polyester; and recycled glass. The modular foundation unit 16, regardless of the material from which it is made, may also comprise any suitable reinforcing fibers or bars for increasing its strength and/or for making it lighter in weight. The punch pad 14 and/or the modular foundation units 16 may be made in any suitable form or mold. Alternatively, instead of using a separate mold or form for the punch pad 14, the bottom portion of the foundation hole 36 for the modular foundation system 10 may serve as the form or mold for the punch pad 14.

Figure 5:
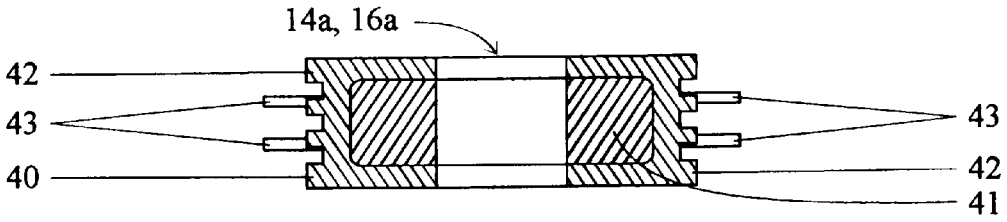
FIG. 5 is a cross-sectional view of an alternative embodiment 16*a* of the modular foundation unit 16, comprising a used tire 40.

Turning now to FIG. 5, an alternative form 14*a* of the punch pad 14 and an alternative form 16*a* of the modular foundation unit 16 may comprise a suitably sized used tire 40 and a ring-shaped core 41 of any suitable moldable, formable or castable construction material such as the ones described above regarding the punch pad 14 and modular foundation 16. The used tire 40 may serve as the form or mold for the ring-shaped core 41; and may comprise a permanent part of the finished punch pad 14*a* or modular foundation unit 16*a*. Such utilization of a used tire 40 may offer at least three advantages. First, the used tire 40 may serve as a free, or as an exceptionally inexpensive, form or mold for the punch pad 14*a* and/or the modular foundation unit 16*a*. Second, when the punch pad 14*a* and/or the modular foundation unit 16*a* is buried in the foundation hole 36 for the modular foundation system 10, its used tire 40 is simultaneously disposed of in a safe, convenient, inexpensive, and environmentally friendly manner. Third, any remaining tread pattern 42 on the used tire 40 of the punch pad 14*a* and/or modular foundation unit 16*a* may serve as ground locking means for helping to lock the surrounding ground 34 to the punch pad 14*a* and/or the modular foundation unit 16*a;* thereby desirably providing greater friction between the ground 34 and the used tire 40 of the punch pad 14*a* and/or the modular foundation unit 16*a*. The greater friction provided by the ground locking means may increase the load bearing capacity, uplift strength and wind resistance of the modular foundation system 10.

The ground locking means for the punch pad 14*a* and/or the modular foundation unit 16*a* may further comprise one or more of any suitable projecting members 43, such as rods, wires, nails or screws, which may have been driven through the tread 42 of the used tire 40 from the inside of the used tire 40, before the used tire 40 is used as a mold or form for the ring-shaped core 41 of the punch pad 14*a* and/or the modular foundation unit 16*a*.

Regarding the axial column 15, the punch pad 14, 14*a* and the modular foundation units 16, 16*a* may serve as the form or mold for the axial column 15.

Referring now to FIGS. 1–4, the axial column 15 may further comprise a pole 24 that may serve the dual functions of reinforcing the axial column 15 and of supporting the structure 12, 12*a*. In addition, the axial column 15 may also comprise any suitable arrangement of additional reinforcing material, such as rebar (reinforcing bar), reinforcing mesh and/or reinforcing fibers.

As best seen in FIG. 1, the pole 24 may have an upper portion whose length may be selected to enable it to extend into the structure 12, such as when the modular foundation system 10 is used to support a pole building type structure 12. Alternatively, as seen in FIG. 2, the pole 24 may have an upper portion whose length may be selected to enable it to extend to the structure 12*a,* so that the modular foundation system 10 may serve as a pier footing for the structure 12*a,* such in the terrace and wall type structure 12*a* seen in FIG. 2.

As best seen in FIGS. 3–4, the pole 24 may comprise several axial bars 25 or axial pipes 25 that may be assembled together and reinforced with cross-bars 26 or cross-pipes 26. Although the pole 24 is illustrated as comprising four axial bars 25 or axial pipes 25, it may comprise fewer, or more, axial bars 25 or axial pipes 25. The axial bars 25 or axial pipes 25 may be made from any suitable construction material, such as wood or steel.

Alternatively, the pole 24 may comprise a single solid member or a single pipe made from any suitable construction material, such as wood or steel. As a further alternative construction, the axial column 15's cap 23 may be eliminated.

Turning now to the punch pad 14 again, although it is illustrated as having a circular shape and a uniform thickness, it may have any other suitable shape and its thickness may not be uniform. Although the punch pad 14's outer radial surface 30 is illustrated as being oriented at a right angle with respect to its upper and lower surfaces 27, 31, its outer radial surface 30 may not be oriented at a right angle with respect to its upper and/or lower surfaces 27, 31; and/or a partial or continuous chamfer may be provided at the intersections between its outer radial surface 30 and its upper and/or lower surfaces 27, 31, to help prevent chipping or breakage of the outer edges of the punch pad 14.

Although the punch pad 14's upper and lower surfaces 27, 31 are illustrated as being equal in outer radial size, they may not 16 be equal in outer radial size. For example, if the punch pad 14 is 17 to be made by slip forming, then its upper and lower surfaces 27, 31 may be selected to be unequal in outer radial size, so that its outer radial surface 30 is tapered; in order to assist the easier removal of the punch pad 14 from its slip form after the material from which it is made has hardened. In addition, the intersections between the punch pad 14's outer radial surface 30 with its upper and/or lower surfaces 27, 31 may be chamfered, to help prevent chipping or breakage of the punch pad 14.

The upper surface 27 of the punch pad 14 and the lower surface 17 of the adjacent modular foundation unit 16 may be entirely flat. Alternatively, their respective surfaces 27, 17 may be, in whole or in part, not entirely flat; and/or may comprise punch pad locking means for helping to properly align their respective surfaces 27, 17 with respect to each other, and for helping to prevent undesired lateral movement of their respective surfaces 27, 17 with respect to each other.

The punch pad locking means may comprise, for example, corresponding complimentary shapes or configurations of their respective surfaces 27, 17; wherein the corresponding complimentary shapes or configurations may be sized and shaped so as to at least partially mate with each other. For example, one of their respective surfaces 27, 17 may have, in whole or in part, a concave shape, and the other may have a corresponding complimentary convex shape, in whole or in part, that may at least partially mate with the concave shape.

Figure 6:
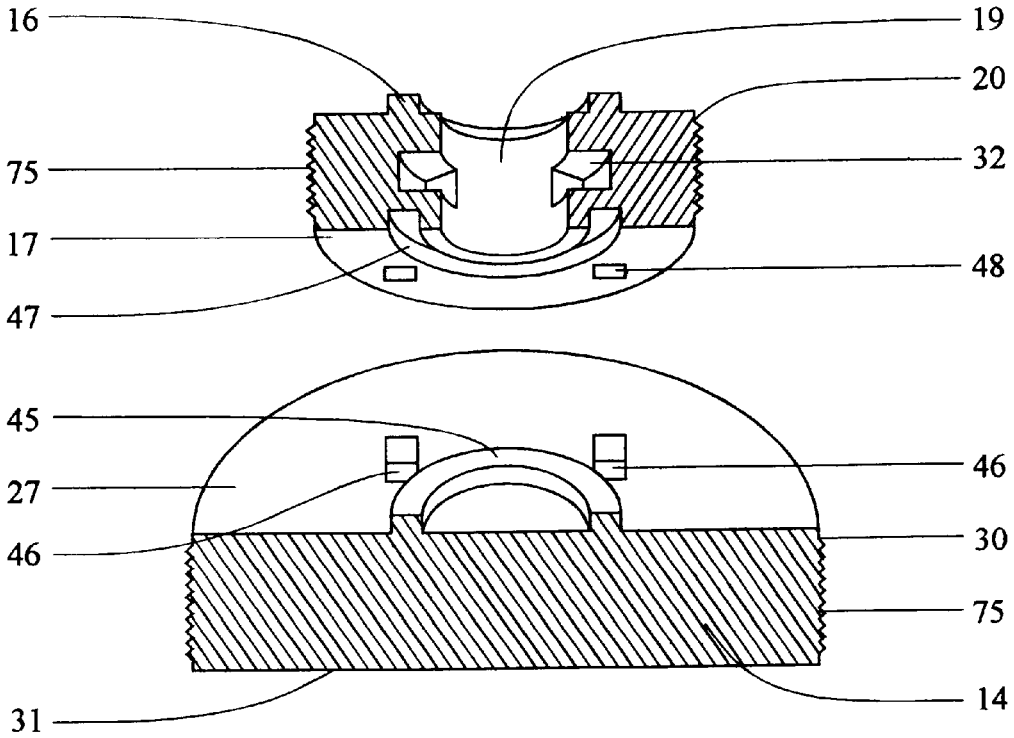
FIG. 6 is a perspective view, partially in cross-section, of a punch pad 14 and an adjacent modular foundation unit 16, prior to being assembled together.

Alternatively, as seen in FIG. 6, most of their respective surfaces 27, 17 may be flat; and the surface 27 of the punch pad 14 may be provided with a projecting flange 45 or lug 46; while the surface 17 of the adjacent modular foundation unit 16 may be provided with a corresponding complimentary groove 47 (to at least partially mate with the flange 45), or with a corresponding complimentary recess 48 (to at least partially mate with the lug 46).

The flange 45 and/or the lug 46 may extend to the punch pad 14's outer radial surface 30. Similarly, the groove 47 and/or the recess 48 may extend to the modular foundation unit 16's inner and/or outer radial surfaces 19, 20.

There may be more than one flange 45, with each flange 45 having any desired cross-sectional shape, size, length, and orientation on the surface 27 of the punch pad 14; and there may be more than one corresponding complimentary groove 47, with each groove 47 having any desired corresponding complimentary cross-sectional shape, size, length, and orientation on the surface 17 of the adjacent modular foundation unit 16. Similarly, there may be more than one lug 46, with each lug 46 having any desired cross-sectional shape, size and orientation on the surface 17 of the adjacent modular foundation unit 16; and there may be more than one corresponding complimentary recess 48, with each recess 48 having any desired corresponding complimentary cross-sectional shape, size and orientation on the surface 17 of the adjacent modular foundation unit 16.

In addition, although the flange 45 and lugs 46 are illustrated as being separate elements, the flange 45 and one or more of the lugs 46 may be extended so as to merge into each other, to form one integral part. Similarly, although the groove 47 and the recesses 48 are illustrated as being separate elements, the groove 47 and one or more of the recesses 48 may be extended so as to merge into each other, to form one integral part.

The sides of the flange 45 and its corresponding groove 47 may have complimentary tapers, to assist in their easy mating with each other, and to increase their resistance to chipping or breakage. Similarly, the sides of the lugs 46 and their corresponding recesses 48 may have complimentary tapers, to assist in their easy mating with each other, and to increase their resistance to chipping or breakage.

Naturally, the groove(s) 47 and/or the recess(es) 48 may be located on the surface 27 of the punch pad 14; and the flange(s) 45 and/or the lug(s) 46 may be located on the surface 17 of the adjacent modular foundation unit 16.

Alternatively, the punch pad locking means may comprise one or more of any suitable projecting members, such as rods, wires, nails or screws, on the surface 27 of the punch pad 14 and/or on the surface 17 of the adjacent modular foundation unit 16; with appropriate corresponding recesses for the projecting members being provided in the corresponding surface 27 of the punch pad 14 and/or the surface 17 of the adjacent modular foundation unit 16. Such projecting members may be the same as, or similar to, the projecting members 43 illustrated in FIG. 5.

Alternatively, the punch pad locking means may be mechanical in nature and may comprise, for example, any suitable fastener(s), tie(s), latch(es), etc.

As best seen in FIG. 4, the punch pad 14 may be provided with a dowel 28 that extends upwardly from the punch pad 14 into the axial column 15. The dowel 28 was omitted from FIG. 6, for clarity. The dowel 28 may serve at least five purposes, namely: (a) reinforcing the punch pad 14; (b) reinforcing the axial column 15; (c) tying the punch pad 14 and the axial column 15 together; (d) properly aligning the punch pad 14, the adjacent modular foundation unit 16 and the axial column 15 with respect to each other; and (e) preventing any lateral movement of the punch pad 14, the adjacent modular foundation unit 16 and the axial column 15 with respect to each other. Thus, the dowel 28 may comprise part of the punch pad locking means that was described above. The dowel 28 may be of any suitable construction and may comprise, for example, several L-shaped lengths of steel rebar 29.

As an alternative, the punch pad 14 and the axial column 15 may be tied together in any other suitable way in addition to, or in lieu of, the dowel 28. The punch pad 14 may also comprise any suitable arrangement of additional reinforcing material, such as rebar, reinforcing mesh and/or reinforcing fibers that may, or may not, extend into the axial column 15.

As an additional alternative, the foundation system 10's punch pad 14 may be eliminated, in which case the lowest modular foundation unit 16 may serve as the modular foundation system 10's punch pad 14. The modular foundation unit 16 serving as the modular foundation system 10's punch pad 14 may comprise a modular foundation unit 16*b* having an outer radial size that is larger than that of at least some of the other modular foundation units 16 in the modular foundation system 10.

Turning now to the modular foundation units 16, in the description which follows only one modular foundation unit 16 will be described in detail, it being understood that part or all of that description may apply equally well to one or more of the other modular foundation units 16 in the modular foundation system 10, as appropriate.

Figure 7:
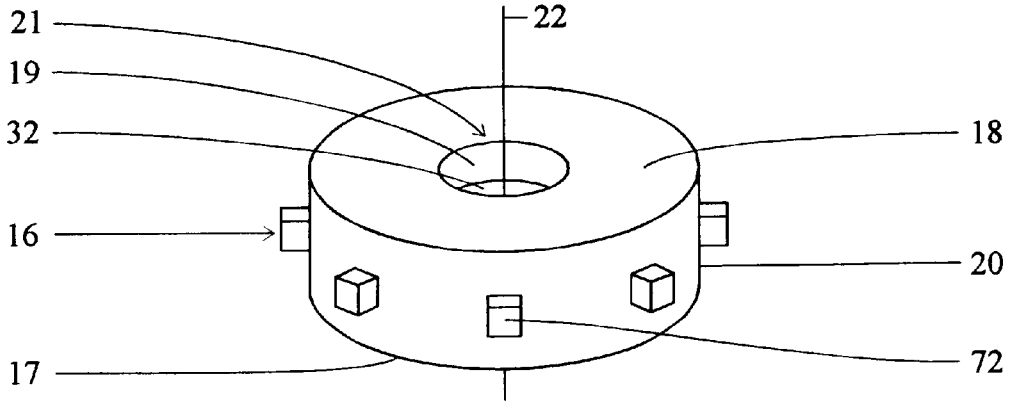
FIG. 7 is a perspective view of another embodiment of the modular foundation unit 16 of the present invention.
Figure 8:
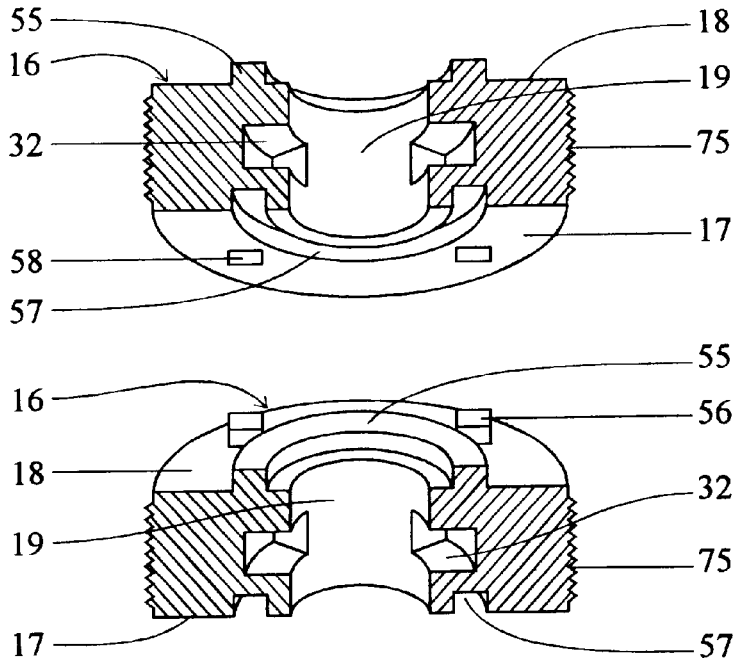
FIG. 8 is a perspective view, partially in cross-section, of two adjacent modular foundation units 16, prior to being assembled together.
Figure 9:
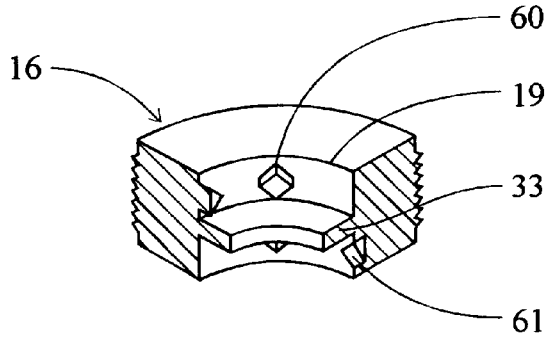
FIG. 9 is a view, partly in cross-section, of another embodiment of the modular foundation unit 16.

As best seen in FIGS. 7–9, the modular foundation unit 16 may comprise a lower surface 17; an upper surface 18; an inner radial surface 19; an outer radial surface 20; an axial opening 21 defined by the inner radial surface 19; and a longitudinal axis 22. The axial opening 21 may, or may not, be centered on the modular foundation unit 16's longitudinal axis 22.

The modular foundation unit 16 may be generally ring-shaped; and its inner and outer radial surfaces 19, 20 may be circular in cross-sectional configuration. Alternatively, its inner and/or outer radial surfaces 19, 20 may have any other suitable cross-sectional configuration, such as elliptical, square, rectangular, triangular, etc. The inner and outer radial surfaces 19, 20 of the modular foundation unit 16 may, or may not, have the same cross-sectional configuration.

The modular foundation unit 16 may have an inner radial size defined by its inner radial surface 19; an outer radial size defined by its outer radial surface 20; a radial thickness defined between its inner and outer radial surfaces 19, 20; and an axial thickness defined between its lower and upper surfaces 17, 18.

The modular foundation units 16 in the modular foundation system 10 may all have the same inner radial size, outer radial size, radial thickness and axial thickness. Alternatively, one or more of the modular foundation units 16 in the foundation system 10 may have a different inner radial size, outer radial size, radial thickness and/or axial thickness. For example, as seen in FIGS. 1–4, one of the modular foundation units 16 in any particular modular foundation system 10 may comprise a modular foundation unit 16*b* that may have a larger outer radial size than the rest of the modular foundation units 16, in order to increase the load bearing capacity, uplift strength, and wind deflection resistance of the modular foundation system 10. In general, the larger the outer radial size of the modular foundation units 16, 16*b*, the greater will be their load bearing capacity, uplift strength, and wind deflection resistance.

The modular foundation unit 16's lower and upper surfaces 17, 18 may be flat and parallel with respect to each other. Alternatively, the surfaces 17, 18 of the modular foundation unit 16 may not be flat and/or may not be parallel with respect to each other.

In addition, the upper surface 18 of a first modular foundation unit 16 and the lower surface 17 of an adjacent second modular foundation unit 16 may not be entirely flat, and may comprise modular foundation unit locking means for helping to properly align their respective surfaces 18, 17 with respect to each other, and for helping to prevent undesired lateral movement of their respective surfaces 18, 17 with respect to each other.

The modular foundation unit locking means may comprise, for example, corresponding complimentary shapes or configurations of their respective surfaces 18, 17; wherein the corresponding complimentary shapes or configurations may be sized and shaped so as to at least partially mate with each other. For example, one of their respective surfaces 18, 17 may have a concave shape, in whole or in part, and the other may have a corresponding complimentary convex shape, in whole or in part, that may at least partially mate with the concave shape.

Alternatively, as seen in FIG. 8, most of their respective surfaces 18, 17 may be flat; and the surface 18 of the first unit 16 may be provided with a projecting flange 55 or lug 56; while the surface 17 of the adjacent second unit 16 may be provided with a corresponding complimentary groove 57 (to at least partially mate with the flange 55), or with a corresponding complimentary recess 58 (to at least partially mate with the lug 56).

There may be more than one flange 55, with each flange 55 having any desired cross-sectional shape, size, length, and orientation on the surface 18 of the first unit 16; and there may be more than one corresponding complimentary groove 57, with each groove 57 having any desired corresponding complimentary cross-sectional shape, size, length, and orientation on the surface 17 of the adjacent second unit 16. Similarly, there may be more than one lug 56, with each lug 56 having any desired cross-sectional shape, size and orientation on the surface 18 of the first unit 16; and there may be more than one corresponding complimentary recess 58, with each recess 58 having any desired corresponding complimentary cross-sectional shape, size and orientation on the surface 17 of the adjacent second unit 16.

Figure 11:
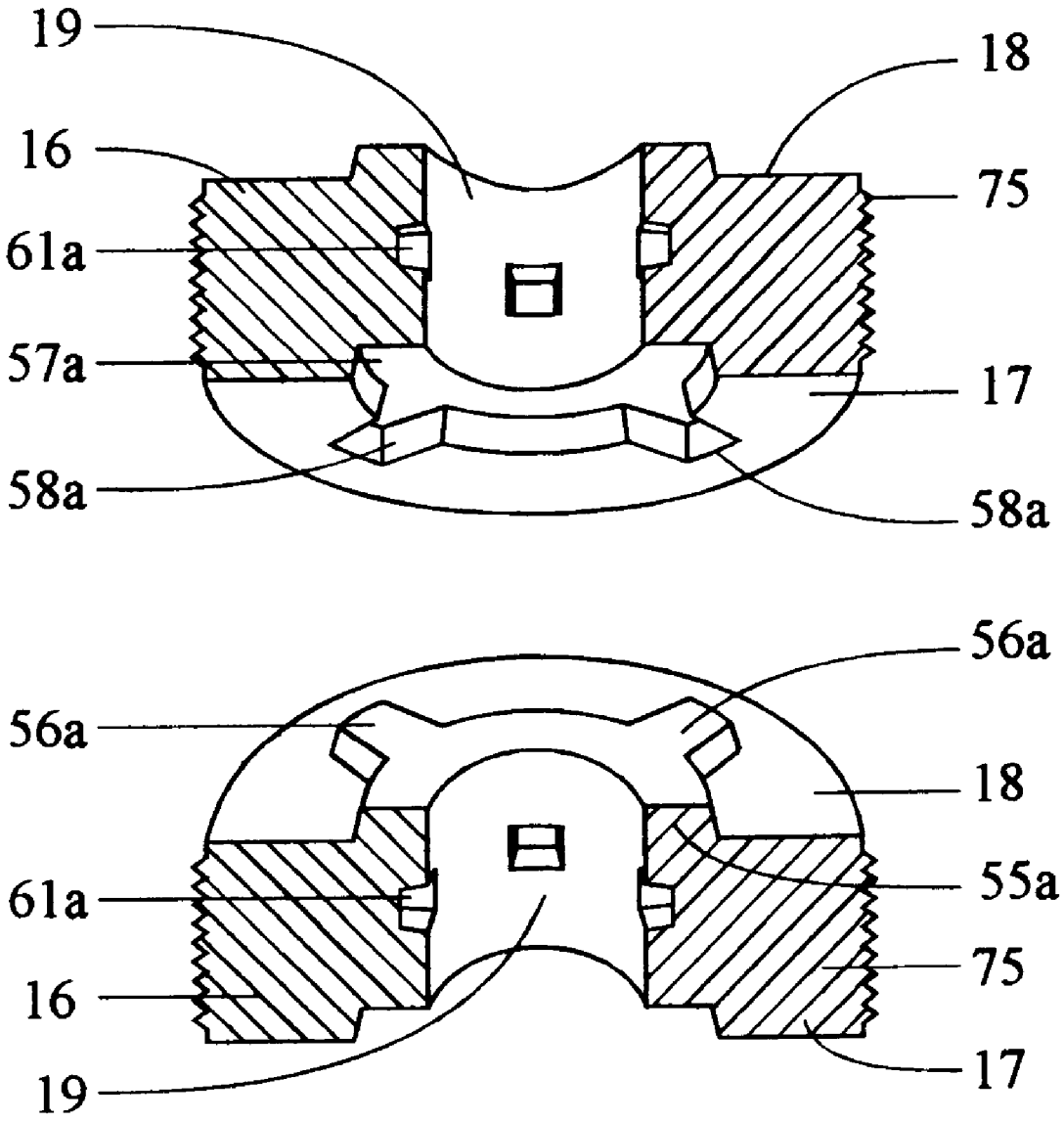
FIG. 11 is a perspective view, partially in cross-section, of another embodiment of two adjacent modular foundation units 16, prior to being assembled together.

In addition, although the flange 55 and the lugs 56 are illustrated as being separate elements, they may be extended so as to merge into each other, to form one integral part. Similarly, although the groove 57 and the recesses 58 are illustrated as being separate elements, they may be extended so as to merge into each other, to form one integral part. For example, as seen in FIG. 11 the flange 55*a* and one or more of the lugs 56*a* may be extended so as to merge into each other, to form one integral part. Similarly, as also seen in FIG. 11, the groove 57*a* and one or more of the recesses 58*a* may be extended so as to merge into each other, to form one integral part.

Further, at least one of the flange 56, the groove 57, the lugs 56, and/or the recesses 58 may extend to the respective unit 16's inner and/or outer radial surfaces 19, 20. For example, in FIG. 11, the inner surfaces of the flange 56*a* and the groove 57*a* are illustrated as extending to the inner radial surfaces 19 of their respective units 16.

The sides of the flange 55 and its corresponding groove 57 may have complimentary tapers, to assist in their easy mating with each other, and to increase their resistance to chipping or breakage. Similarly the sides of the lugs 56*a* and their corresponding recesses 58*a* may have complimentary tapers, to assist in their easy mating with each other, and to increase their resistance to chipping or breakage. For example, in FIG. 11, the sides of the flange 55*a*, groove 57*a*, lugs 56*a* and recesses 58*a* are illustrated as having such complimentary tapers.

Naturally, the groove(s) 57, 57*a* and/or the recess(es) 58, 58*a* may be located on the surface 18 of the first unit 16; and the flange(s) 45, 45*a* and/or the lug(s) 46, 46*a* may be located on the surface 17 of the adjacent second unit 16.

Alternatively, the modular foundation unit locking means may comprise one or more of any suitable projecting members, such as rods, wires, nails or screws, on the surface 18 of the first unit 16 and/or on the surface 17 of the adjacent second unit 16; with appropriate corresponding recesses for the projecting members being provided in the corresponding surfaces 17, 18 of the first and/or second units 16. Such projecting members may be the same as, or similar to, the projecting members 43 illustrated in FIG. 5.

Alternatively, the modular foundation unit locking means may be mechanical in nature and may comprise, for example, any suitable fastener(s), tie(s), latch(es), etc.

Although the modular foundation unit 16's inner and outer radial surfaces 19, 20 are illustrated as being oriented at a right angle with respect to the unit 16's lower and upper surfaces 17, 18, its inner and/or outer radial surfaces 19, 20 may not be oriented at a right angle with respect to its lower and/or upper surfaces 17, 18; and/or a partial or continuous chamfer may be provided at the intersections between its inner and/or outer radial surfaces 19, 20 and its lower and/or upper surfaces 17, 18, to help prevent chipping or breakage of the outer edges of the unit 16.

Although the modular foundation unit 16's lower and upper surfaces 17, 18 are illustrated a being equal in size, they may not be equal in size. For example, if the modular foundation unit 16 is to be at least partially made by slip forming, then its lower and upper surfaces 17, 18 may be selected to be unequal in size, so that its inner and/or outer radial surfaces 19, 20 are tapered; in order to assist the easier removal of the modular foundation unit 16 from its slip form after the material from which it is made has hardened.

The modular foundation unit 16 may further comprise axial column locking means on its inner radial surface 19 for helping to lock the modular foundation unit 16 and the axial column 15 together, and for helping to prevent relative axial motion between the modular foundation unit 16 and the axial column 15; after the axial column 15 has been poured and has hardened.

The axial column locking means may comprise any variation in the inner radial size of the modular foundation unit 16 as one travels along its longitudinal axis 22. For example, the inner radial surface 19 of the modular foundation unit 16 may be, in whole or in part, concave or convex in longitudinal cross-section. Alternatively, the inner radial surface 19 of the modular foundation unit 16 may be tapered, in whole or in part, as one travels between the lower and upper surfaces 17, 18 of the modular foundation unit 16.

Alternatively, the axial column locking means may, as seen in FIGS. 4–5, comprise a ring-shaped groove 32 of any desired size on the inner radial surface 19 of the modular foundation unit 16. Although only one groove 32 is illustrated, there may be more than one groove 32 which may be spaced equally, or unequally, about the inner radial surface 19 of the modular foundation unit 16. Although the groove 32 is illustrated as following a straight path, it may follow any other suitable path, such a zig-zag, curved and/or sinuous.

Although the groove 32 is illustrated as being continuous, it may be discontinuous and it may comprise two or more groove segments which may, or may not, lie in a common plane. Although the groove 32 is illustrated as having a generally rectangular cross-sectional configuration, it may have any other suitable cross-sectional configuration. Although the groove 32 is illustrated as being located in a plane that intersects the modular foundation unit 16's longitudinal axis 22 at a right angle, it may be located in a plane that does not intersect the modular foundation unit 16's longitudinal axis 22 at a right angle.

Alternatively, the groove 32 and the modular foundation unit 16's longitudinal axis 22 may be at least generally co-planar; and such a groove 32 may, or may not, extend the full distance between the modular foundation unit 16's lower and upper surfaces 17, 18. There may be two, or more, such grooves 32, which may be spaced equally, or unequally, about the inner radial surface 19 of the modular foundation unit 16. If the inner radial surface 19 of the modular foundation unit 16 is to be slip formed, then the groove(s) 32 and the modular foundation unit 16's longitudinal axis 22 may be at least generally co-planar, and the groove(s) 32 may extend part or all of the full distance between the modular foundation unit 16's lower and upper surfaces 17, 18; in order to assist the easier removal of the modular foundation unit 16 from its slip form after the material from which it is made has hardened.

As best seen in FIG. 9, the axial column locking means may comprise a ring-shaped flange 33 of any desired size on the inner radial surface 19 of the modular foundation unit 16. Although only one flange 33 is illustrated, there may be more than one flange 33, which may be spaced equally, or unequally, about the inner radial surface 19 of the modular foundation unit 16. Although the flange 33 is illustrated as following a straight path, it may follow any other suitable path, such a zig-zag, curved and/or sinuous.

Although the flange 33 is illustrated as being continuous, it may be discontinuous and comprise two or more flange segments which may, or may not, lie in a common plane. Although the flange 33 is illustrated as having a generally rectangular cross-sectional configuration, it may have any other suitable cross-sectional configuration. Although the flange 33 is illustrated as being located in a plane that intersects the modular foundation unit 16's longitudinal axis 22 at a right angle, it may be located in a plane that does not intersect the modular foundation unit 16's longitudinal axis 22 at a right angle.

Alternatively, the flange 33 and the modular foundation unit 16's longitudinal axis 22 may be at least generally co-planar; and such a flange 33 may, or may not extend the full distance between the modular foundation unit 16's lower and upper surfaces 17, 18. There may be two, or more, such flanges 33, which may be spaced equally, or unequally, about the inner radial surface 19 of the modular foundation unit 16. If the inner radial surface 19 of the modular foundation unit 16 is to be slip formed, then the flange(s) 33 and the modular foundation unit 16's longitudinal axis 22 may be at least generally co-planar, and the flange(s) 33 may extend part or all of the full distance between the modular foundation unit 16's lower and upper surfaces 17, 18; in order to assist the easier removal of the modular foundation unit 16 from its slip form after the material from which it is made has hardened.

Alternatively, as seen in FIGS. 9 and 11, the axial column locking means may comprise a pattern of lugs 60 and/or recesses 61 of any suitable size, shape and number on the inner radial surface 19 of the modular foundation unit 16 (FIG. 9), or a pattern of recesses 61*a* on the inner radial surface 19 of the unit 16 (FIG. 11). There may be as few as one lug 60 and/or recess 61, 61*a*. One or more of the groove 32, the flange 33, the lugs 60, and/or the recesses 61, 61*a* may merge into each other, to form one integral part, and/or may extend to the lower and/or upper surfaces 17, 18 of the unit 16.

Alternatively, the axial column locking means may comprise one or more of any suitable projecting members, such as rods, wires, nails or screws, which project radially inwardly from the inner radial surface 19 of the modular foundation unit 16 into the axial opening 21 of the modular foundation unit 16. Such projecting members may be the same as, or at least similar to, the projecting members 43 of the modular foundation unit 16*a* of FIG. 5.

The modular foundation unit 16 may further comprise ground locking means for helping to lock the modular foundation units 16 and the surrounding ground 34 together, after the foundation hole 36 has been back-filled. The ground locking means may desirably provide greater friction between the modular foundation unit 16 and the surrounding ground 34 than may otherwise be the case; thereby increasing the load bearing capacity, uplift strength and wind resistance of the completed modular foundation system 10.

The modular foundation unit 16's ground locking means may comprise any variation in the outer radial size of the modular foundation unit 16 as one travels along its longitudinal axis 22. For example, the outer radial surface 20 of the modular foundation unit 16 may be, in whole or in part, concave or convex in longitudinal cross-section.

Alternatively, the outer radial surface 20 of the modular foundation unit 16 may be tapered, in whole or in part, as one travels between the lower and upper surfaces 17, 18 of the modular foundation unit 16.

Alternatively, the modular foundation unit 16's ground locking means may comprise a partial or continuous pattern 75 of any size, shape, length and orientation of grooves and/or recesses on the outer radial surface 20 of the modular foundation unit 16. For clarity, the pattern 75 is not illustrated on the outer radial surface 20 of the foundation unit 16 in FIGS. 1–3, 5, 7, and 9–10. A similar ground locking means pattern 75 may be provided on the outer surface 30 of the punch pad 14, as best seen in FIGS. 4 and 6. Although not illustrated, for clarity, such a pattern 75 may also be provided on the inner radial surface 19 of the unit 16, to serve as an axial column locking means for the unit 16.

Figure 10:
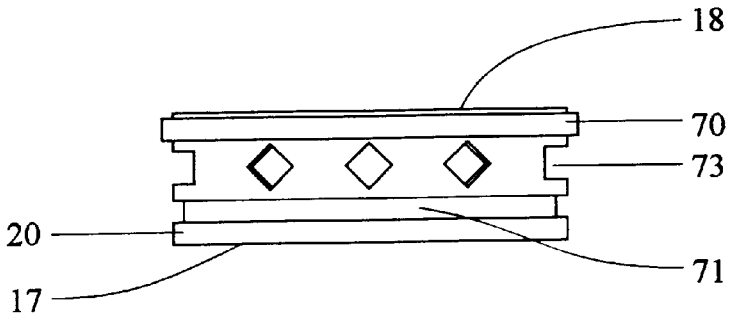
FIG. 10 is a side elevational view of the outer radial surface 20 of a further embodiment of the modular foundation unit 16.

Alternatively, as seen in FIG. 10, the modular foundation unit 16's ground locking means may comprise a ring-shaped flange 70 and/or groove 71 of any desired size on the outer radial surface 20 of the modular foundation unit 16. Although only one flange 70 and groove 71 are illustrated, there may be more than one flange 70 and/or groove 71 which may be spaced equally, or unequally, about the outer radial surface 20 of the modular foundation unit 16. Although the flange 70 and groove 71 are illustrated as following a straight path, the flange 70 and/or groove 71 may follow any other suitable path, such a zig-zag, curved and/or sinuous.

Although the flange 70 and groove 71 are illustrated as being continuous, the flange 70 and/or the groove 71 may be discontinuous and the flange 70 and/or the groove 71 may comprise two or more segments which may, or may not, lie in a common plane. Although the flange 70 and the groove 71 are illustrated as having generally rectangular cross-sectional configurations, the flange 70 and/or the groove 71 may have any other suitable cross-sectional configurations. Although the flange 70 and the groove 71 are illustrated as being located in a plane that intersects the modular foundation unit 16's longitudinal axis 22 at a right angle, the flange 70 and/or the groove 71 may be located in a plane that does not intersect the modular foundation unit 16's longitudinal axis 22 at a right angle.

Alternatively, the modular foundation unit 16's longitudinal axis 22, and the flange 70 and/or the groove 71, may be at least generally co-planar; and such a flange 70 and/or groove. 71 may, or may not, extend the full distance between the modular foundation unit 16's lower and upper surfaces 17, 18. There may be two, or more, such flanges 70 and/or grooves 71, which may be spaced equally, or unequally, about the outer radial surface 20 of the modular foundation unit 16. If the outer radial surface 20 of the modular foundation unit 16 is to be slip formed, then the modular foundation unit 16's longitudinal axis 22, and the flange(s) 70 and/or the groove(s) 71, may be at least generally co-planar, and the flange(s) 70 and/or the groove(s) 71 may extend part or all of the full distance between the modular foundation unit 16's lower and upper surfaces 17, 18; in order to assist the easier removal of the modular foundation unit 16 from its slip form after the material from which it is made has hardened.

Alternatively, the modular foundation unit 16's ground locking means may comprise a pattern of lugs 72 (FIG. 7) and/or recesses 73 (FIG. 10) of any suitable size, shape and number on the outer radial surface 20 of the modular foundation unit 16. There may be as few as one lug 72 and/or recess 73.

In addition, one or more of the flange 70, the groove 71, the lugs 72, and/or the recesses 73 may merge into each other, to form one integral part, and/or may extend to the lower and/or upper surfaces 17, 18 of the unit 16.

Alternatively, the modular foundation unit 16's ground locking means may comprise one or more of any suitable projecting members, such as rods, wires, nails or screws, which project radially outwardly from the outer radial surface 20 of the modular foundation unit 16 into the axial opening 21 of the modular foundation unit 16. Such projecting members may be the same as, or at least similar to, the projecting members 43 of the modular foundation unit 16*a* of FIG. 5.

The modular foundation unit 16 may also comprise any suitable arrangement of reinforcing material, such as rebar, reinforcing mesh and/or reinforcing fibers.

Turning again to the punch pad 14, it may also further comprise ground locking means for helping to lock the punch pad 14 and the surrounding ground 34 together, after the foundation hole 36 has been back-filled. The punch pad ground locking means may desirably provide greater friction between the punch pad 14 and the surrounding ground 34 than may otherwise be the case; thereby increasing the load bearing capacity, uplift strength and wind resistance of the completed modular foundation system 10. The punch pad ground locking means may be the same as, or at least similar to, any of the modular foundation unit ground locking means that were described above in detail.

Turning now to the installation of the modular foundation system 10, its foundation hole 36 may be formed in the ground in any suitable way, such as by auguring. Once the foundation hole 36 has been formed, the punch pad 14 may be lowered to the bottom of the foundation hole 36, if the punch pad 14 has been pre-made, after which the punch pad 14 may be leveled so that its upper surface 18 is at least generally horizontal. It should be recalled that the punch pad 14 may comprise a modular foundation unit 16 or 16*a*.

Alternatively, the punch pad 14 may be poured in place in the bottom of the foundation hole 36 by using the bottom portion of the foundation hole 36 as the form for the punch pad 14; after which the punch pad 14 may then be allowed to harden for the desired length of time. The upper surface 18 of such a poured in place punch pad 14 may be self-leveling, due to the force of gravity.

After the finished punch pad 14 is in place at the bottom of the foundation hole 36, the modular foundation units 16, 16*a* may then be stacked on top of the punch pad 14, with their axial openings 21 at least generally axially aligned. The pole 24 for the axial column 15 may then be lowered into the axial opening(s) 21 of the modular foundation units 16, and centered; and the bottom of the pole 24 may be supported by the upper surface 27 of the punch pad 14. The pole 24 may then be held in place in any suitable way. After the pole 24 is in place, the axial column 15 may then be poured and its cap 23 may be formed and finished. After the axial column 15 has been allowed to harden for the desired length of time, the foundation hole 36 for the modular foundation system 10 may then be back-filled; at which time the modular foundation system 10 may be ready for use. As best seen in FIG. 4, the hardened axial column 15 may serve to hold the punch pad 14, the modular foundation units 16, 16*a* and the pole 24 together as one strong, integral structure.

It is understood that the foregoing forms of the invention were described and/or illustrated strictly by way of non-limiting example.

In view of all of the disclosures herein, these and further modifications, adaptations and variations of the present invention will now be apparent to those skilled in the art to which it pertains, within the scope of the following claims.

What is claimed is:

1. A modular foundation system comprising:

first and second ring-shaped, pre-formed, modular foundation units; an elongated pole; and an elongated axial column;

wherein said first and second modular foundation units each comprise an inner radial surface that defines an axial opening;

wherein said first and second modular foundation units are on top of each other, with said axial openings at least partially aligned;

wherein an anchored part of said elongated pole extends at least substantially through said axial openings to create an axial space between said anchored part of said elongated pole and said inner radial surfaces of said first and second modular foundation units;

wherein said axial column extends at least substantially through said axial openings, wherein said axial column at least substantially surrounds said anchored part of said elongated pole and wherein said axial column at least substantially fill said axial space; and wherein a free part of said elongated pole extends outwardly from a top portion of said axial column.

2. The modular foundation system according to claim 1, wherein said first modular foundation unit comprises an upper surface; wherein said second modular foundation unit comprises a lower surface; and wherein said modular foundation system further comprises a modular foundation unit locking means for helping to properly align said upper and lower surfaces of said first and second modular foundation units with respect to each other, and for helping to prevent undesired lateral movement of said upper and lower surfaces of said first and second modular foundation units with respect to each other.

3. The modular foundation system according to claim 2, wherein said modular foundation unit locking means comprises complimentary configurations of said upper and lower surfaces of said first and second modular foundation units; and wherein said complimentary configurations are sized and shaped to permit said complimentary configurations to at least partially mate with each other when said first and second modular foundation units are stacked on top of each other.

4. The modular foundation system according to claim 3, wherein said complimentary configurations of said upper and lower surfaces of said first and second modular foundation units comprise at least one of a convex surface, a concave surface, a tapered surface, a flange, a flange groove, a lug, a lug recess or a projecting member.

5. The modular foundation system according to claim 1, wherein said modular foundation system further comprises an axial column locking means for helping to lock together said axial column and at least one of said first and second modular foundation units, and for helping to prevent relative axial motion between said axial column and said at least one of said first and second modular foundation units.

6. The modular foundation system according to claim 5, wherein said axial column locking means comprises/at least one of a convex surface, a concave surface, a tapered surface, a flange, a groove, a lug, a recess or a projecting member on said inner radial surface of said at least one of said first and second modular foundation units.

7. The modular foundation system according to claim 1, wherein said first and second modular foundation units each comprise an outer radial surface; and wherein said modular foundation system further comprises a modular foundation unit ground locking means for helping to lock said outer radial surface of at least one of said first and second modular foundation units to a surrounding portion of ground.

8. The modular foundation system according to claim 7, wherein said modular foundation unit ground locking means comprises at least one of a convex surface, a concave surface, a tapered surface, a flange, a groove, a lug, a recess, or a projecting member on said outer radial surface of said at least one of said first and second modular foundation units.

9. The modular foundation system according to claim 1 wherein said first and second modular foundation units each comprise an outer radial size; and wherein said outer radial size of said first modular foundation unit is larger than said outer radial size of said second modular foundation unit.

10. The modular foundation system according to claim 1, wherein said modular foundation system further comprises a punch pad.

11. The modular foundation system according to claim 10, wherein said punch pad comprises a third modular foundation unit.

12. The modular foundation system according to claim 10, wherein said punch pad further comprises an axial column connecting means for connecting together said punch pad and said axial column.

13. The modular foundation system according to claim 12, wherein said axial column connecting means comprises a dowel that extends from said punch pad into said axial column.

14. The modular foundation system according to claim 10, wherein said punch pad comprises an upper surface; wherein said first modular foundation unit comprises a lower surface; and wherein said modular foundation system further comprises a punch pad locking means for helping to properly align said upper surface of said punch pad and said lower surface of said first modular foundation unit with respect to each other, and for helping to prevent undesired lateral movement of said upper surface of said punch pad and said lower surface of said first modular foundation unit with respect to each other.

15. The modular foundation system according to claim 14, wherein said punch pad locking means comprises complimentary configurations of said upper surface of said punch pad and said lower surface of said first modular foundation unit.

16. The modular foundation system according to claim 15, wherein said complimentary configurations of said upper surface of said punch pad and said lower surface of said first modular foundation unit comprise at least one of a convex surface, a concave surface, a tapered surface, a flange, a flange groove, a lug, a lug recess or a projecting member.

17. The modular foundation system according to claim 10, wherein said punch pad comprises an outer radial surface; and wherein said modular foundation system further comprises a punch pad ground locking means for helping to lock said outer radial surface of said punch pad to a surrounding portion of ground.

18. The modular foundation system according to claim 17, wherein said punch pad ground locking means comprises at least one of a convex surface, a concave surface, a tapered surface, a flange, a groove, a lug, a recess, or a projecting member on said outer radial surface of said punch pad.

* * * * *